US010305218B2

(12) United States Patent
Griepenstroh et al.

(10) Patent No.: US 10,305,218 B2
(45) Date of Patent: May 28, 2019

(54) PROTECTIVE CAP FOR AN ATTACHMENT HOUSING

(71) Applicant: HARTING Electric GmbH & Co. KG, Espelkamp (DE)

(72) Inventors: Sebastian Griepenstroh, Lübbecke (DE); Florian Schenk, Löhne (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 15/567,526

(22) PCT Filed: Mar. 30, 2016

(86) PCT No.: PCT/DE2016/100150

§ 371 (c)(1),
(2) Date: Oct. 18, 2017

(87) PCT Pub. No.: WO2016/177360

PCT Pub. Date: Nov. 10, 2016

(65) Prior Publication Data

US 2018/0123281 A1 May 3, 2018

(30) Foreign Application Priority Data

May 5, 2015 (DE) ..... 10 2015 106 963

(51) Int. Cl.
*H01R 13/506* (2006.01)
*H01R 13/52* (2006.01)
*H01R 13/629* (2006.01)

(52) U.S. Cl.
CPC ..... *H01R 13/5213* (2013.01); *H01R 13/506* (2013.01); *H01R 13/62938* (2013.01)

(58) Field of Classification Search
CPC .... H01R 13/447; H01R 13/506; H01R 13/24; H01R 13/6273; H01R 4/2433;
(Continued)

(56) References Cited

U.S. PATENT DOCUMENTS 4,451,101 A * 5/1984 Davis ..... H01R 13/447 174/67
4,825,466 A * 4/1989 Dowler ..... H04M 1/24 379/413.02

(Continued)

FOREIGN PATENT DOCUMENTS

CN 101005174 A 7/2007
CN 203503886 U 3/2014

(Continued)

OTHER PUBLICATIONS

International Preliminary Report on Patentability, dated Nov. 7, 2017, for International Application No. PCT/DE2016/100150, 6 pages. (English Translation).

(Continued)

*Primary Examiner* — Truc T Nguyen
(74) *Attorney, Agent, or Firm* — Seed IP Law Group LLP

(57) ABSTRACT

The disclosure relates to a protective cap for an attachment housing. The protective cap has a basic shape which is substantially box-shaped. The protective cap has a first locking device on the narrow faces of the box-shaped basic shape, and the protective cap has a second locking device on at least one broad face of the box-shaped basic shape. The disclosure likewise relates to a system comprising such a protective cap and a matching attachment housing. Advantageously, the locking devices of the protective cap can be used with and without a locking bracket of an attachment housing.

8 Claims, 4 Drawing Sheets

(58) Field of Classification Search
CPC ..... H01R 13/5213; H01R 2201/26; H01R 12/675; H01R 13/18; H01R 13/2442; H01R 13/5216; H01R 13/5829; H01R 13/5845; H01R 13/627
See application file for complete search history.

(56) References Cited

U.S. PATENT DOCUMENTS

| | | | | |
|---|---|---|---|---|
| 4,979,209 | A * | 12/1990 | Collins | H02G 3/14 379/413.04 |
| 5,218,169 | A * | 6/1993 | Riceman | H01R 13/447 174/67 |
| 5,263,871 | A * | 11/1993 | Sano | H01R 13/62933 439/157 |
| 5,658,162 | A * | 8/1997 | Harting | H01R 13/62966 439/157 |
| 5,815,886 | A * | 10/1998 | Nishio | E05D 11/0027 16/261 |
| 6,446,906 | B1 * | 9/2002 | Voigt | B64C 9/36 244/3.27 |
| 7,121,847 | B1 * | 10/2006 | Jetton | H01R 13/527 439/76.2 |
| 7,419,391 | B2 | 9/2008 | Schmidt | |
| 7,549,541 | B2 * | 6/2009 | Brozell | B65D 83/0463 206/531 |
| 7,815,456 | B2 * | 10/2010 | Kunioka | H01R 13/2421 439/331 |
| 7,915,528 | B2 | 3/2011 | Ni | |
| 8,888,516 | B2 * | 11/2014 | Yu | H01R 24/64 439/144 |
| 9,413,100 | B2 | 8/2016 | Gerullis | |
| 9,705,298 | B2 * | 7/2017 | Dinh | H02G 3/185 |
| 2002/0185404 | A1 * | 12/2002 | Donegan | B65D 77/02 206/531 |
| 2003/0199185 | A1 | 10/2003 | Fujii et al. | |
| 2005/0026484 | A1 * | 2/2005 | Demuth | H01R 13/62944 439/157 |
| 2007/0167046 | A1 | 7/2007 | Shigeta et al. | |
| 2009/0114653 | A1 * | 5/2009 | Schenker | B65D 25/32 220/324 |
| 2010/0048039 | A1 * | 2/2010 | Parrish | H01R 13/64 439/55 |
| 2010/0248513 | A1 * | 9/2010 | Ferderer | H01R 13/62955 439/157 |
| 2014/0154898 | A1 * | 6/2014 | Pierik | H01R 13/62966 439/76.2 |
| 2014/0183075 | A1 * | 7/2014 | Horiyama | B25H 3/02 206/349 |
| 2015/0017288 | A1 * | 1/2015 | Lo Faro | A47J 31/407 426/112 |

FOREIGN PATENT DOCUMENTS

| | | | |
|---|---|---|---|
| CN | 103944005 | A | 7/2014 |
| CN | 104218381 | A | 12/2014 |
| DE | 24 51 662 | A1 | 5/1976 |
| DE | 691 14 560 | T2 | 4/1996 |
| DE | 10 2010 061 384 | A1 | 7/2011 |
| DE | 10 2012 102 188 | A1 | 9/2013 |
| DE | 10 2013 004 551 | A1 | 9/2014 |
| EP | 0 451 970 | B1 | 11/1995 |
| EP | 1 830 433 | A2 | 9/2007 |
| EP | 1 914 843 | A1 | 4/2008 |
| RU | 2 161 849 | C1 | 1/2001 |
| WO | 2014/115051 | A1 | 7/2014 |

OTHER PUBLICATIONS

German Office Action, dated Jan. 8, 2016, for German Application No. 10 2015 106 963.6, 5 pages.
International Search Report and Written Opinion, dated Jul. 21, 2016, for International Application No. PCT/DE2016/100150, 10 pages. (with English Translation of Search Report).
Chinese Office Action, dated Nov. 1, 2018, for Chinese Application No. 201680023289.6, 10 pages. (with English Translation).
Russian Search Report, dated Jun. 20, 2018, for Russian Application No. 2017134486/07(060681), 2 pages.

* cited by examiner

PROTECTIVE CAP FOR AN ATTACHMENT HOUSING

BACKGROUND

Technical Field

This disclosure relates to a protective cap for an attachment housing and a system comprising a protective cap and a matching attachment housing.

Protective caps of this type are used to close attachment housings for plug connections of a machine or an appliance securely and tightly against media when no plug connector is plugged into the attachment housing.

Description of the Related Art

DE 10 2010 061 384 A1 shows a protective cap for an attachment housing, wherein the protective cap has a locking pin on each of the narrow sides of the box-like basic shape, and wherein the protective cap has a locking magnet on at least one wide side of the box-like basic shape.

U.S. Pat. No. 7,915,528 B2 shows a protective cap for an attachment housing, wherein the protective cap a locking eye is integrally molded on at least one wide side of the box-like basic shape.

DE 691 14 560 T2 shows a socket securing cap which has two hinge receptacles on a wide side and, on at least one narrow side, a locking tongue which can be engaged in a locking lug on the socket.

DE 10 2013 004 551 A1, DE 10 2012 102 188 A1 and DE 24 51 662 A1 each show a protective cap for an attachment housing, wherein the protective caps each have a locking pin on the narrow sides of the box-like basic shape.

EP 1 830 430 3A3 shows an attachment housing for a plug connection. The protective cap is connected in an articulated manner to the attachment housing at two points. Via a pivoting movement, the protective cap can be folded onto the attachment housing and fixed thereto via a locking clip.

A locking mechanism of this type is complex and subject to wear. In addition, the protective cap is irreversibly connected to the attachment housing, which can cause space problems for the plug connector.

BRIEF SUMMARY

Embodiments of the present invention provide a protective cap for an attachment housing which can be handled simply and produced inexpensively.

Embodiments of the present invention are directed to a protective cap that is provided for the media-tight sealing of an attachment housing of a plug connection. The protective cap has a substantially box-like basic shape. The attachment housing has first locking device on each of the narrow sides of the box-like basic shape. The protective cap comprises a second locking device on at least one wide side of the box-like basic shape. The first and second locking devices are different.

In an attachment housing there are generally contact elements which can make electrical contact with corresponding contact elements of a plug connector that can be plugged into or onto the attachment housing.

Advantageously, the first locking device comprises locking pins. A locking clip which can engage over the locking pins can be pivotably attached to the attachment housing. As a result, the protective cap is fixed on the attachment housing particularly securely and media-tightly.

In a particularly advantageous refinement, the two wide sides of the box-like basic shape have a locking device. Preferably, the two wide sides have different locking devices, wherein one wide side has the second locking device and the other wide side has a third device. In an advantageous refinement, the second locking device is a locking lug. Preferably, the third locking device is part of a hinge. The attachment housing has the other part of the hinge. The protective cap is accordingly connected to the attachment housing via a hinge connection. The attachment housing has a latching protrusion over which the locking lug of the protective cap can engage, by which fixing of the protective cap to the attachment housing is carried out in the closed state. By way of the second and third locking devices, the protective cap can be fixed to the attachment housing without a locking clip.

BRIEF DESCRIPTION OF THE SEVERAL VIEWS OF THE DRAWINGS

An exemplary embodiment of the invention is illustrated in the drawings and will be explained in more detail below. In the drawings.

The figures contain partially simplified schematic illustrations. To some extent, identical designations are used for the same but possibly not identical elements. Various views of the same elements could be scaled differently.

DETAILED DESCRIPTION

Figure 1:
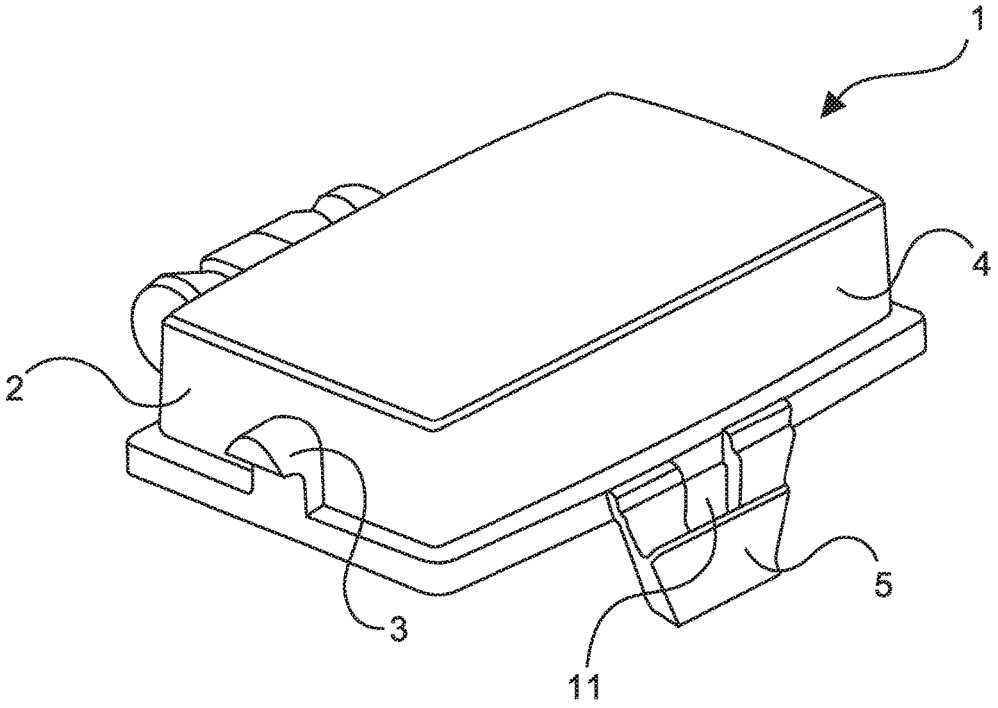
FIG. 1 shows a perspective illustration of a protective cap.
Figure 2:
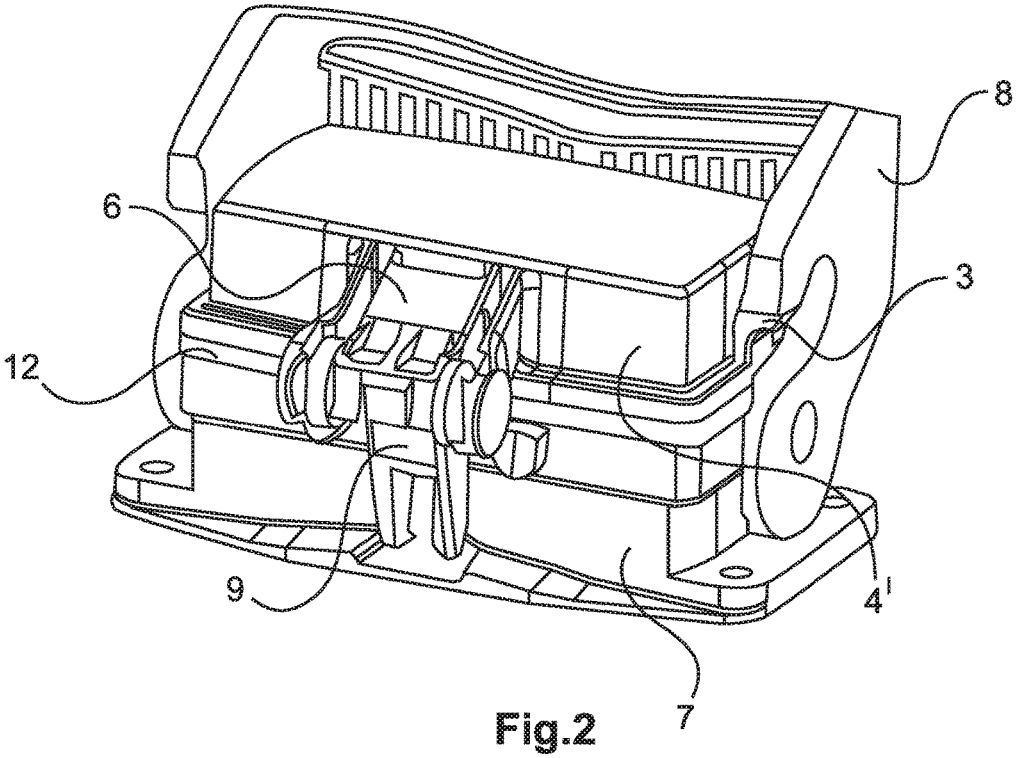
FIG. 2 shows a perspective illustration of a system comprising a protective cap and an attachment housing with locking clip.

FIG. 1 shows a perspective illustration of a protective cap 1 according to an example embodiment of the invention. The protective cap 1 has a substantially box-like shape. Locking pins 3 are integrally molded on both narrow sides 2 of the protective cap 1. From one wide side 4, a locking lug 5 integrally molded thereon projects. Part of a hinge 6 is integrally molded on the opposite wide side 4'.

In FIGS. 2, 3 and 5-7, in each case a system comprising a protective cap 1 and an attachment housing 7 can be seen. In these embodiments, a locking clip 8 is pivotably fixed to the attachment housing 7 and, in interaction with the locking pins 3, fixes the protective cap 1 reversibly to the attachment housing 7. The attachment housing 7 has a second part of a hinge 9, which is either integrally molded on the attachment housing 7 or fixed thereto. As a result of the hinge connection, the protective cap 1 can be pivoted open and expose a plug-in area (not shown) within the attachment housing 7. Pivoting closed in order to close the attachment housing 7 is likewise possible.

Figure 3:
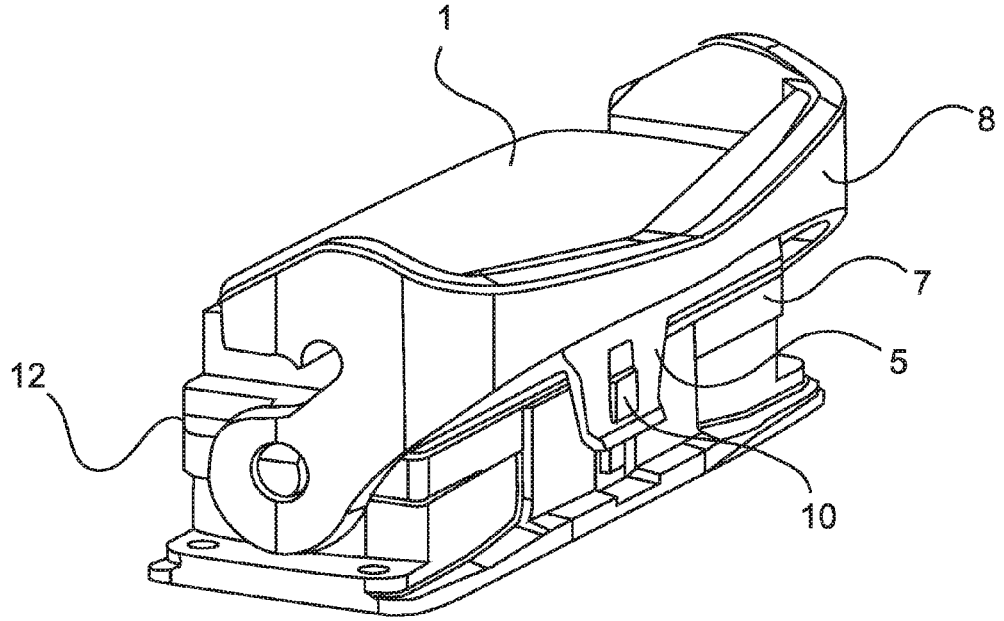
FIG. 3 shows a further perspective illustration of the system comprising a protective cap and an attachment housing with locking clip.
Figure 4:
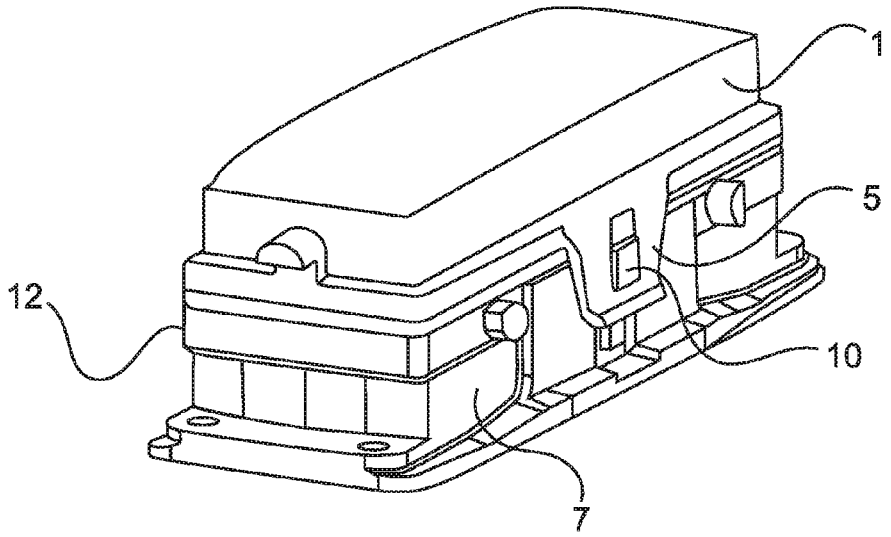
FIG. 4 shows a further perspective illustration of the system comprising a protective cap and an attachment housing without locking clip.

The locking lug 5 integrally molded on the protective cap 1 can be guided over a latching projection 10 integrally molded on the attachment housing 7, as shown, for example, in FIG. 3. In the process, the front beveled edge of the locking lug 5 initially slides over the latching projection 10. The locking lug 5 then snaps over the latching projection 10, so that the latter is then located in a cut-out 11 in the locking lug 5. The hinge 6, 9 and the locking lug 5 are sufficient to fix the protective cap 1 to the attachment housing 7 in a media-tight and reversible manner. A gasket 12 is provided between the protective cap 1 and the attachment housing 7.

Figure 5:
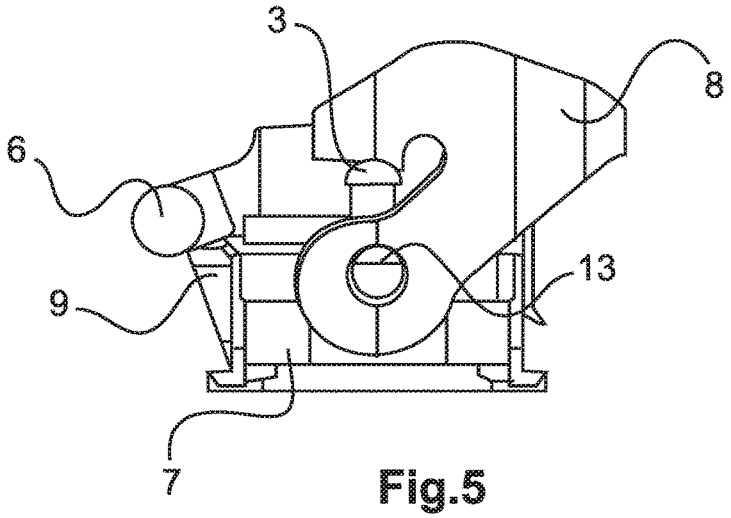
FIG. 5 shows a lateral illustration of the system comprising a protective cap and an attachment housing with locking clip.
Figure 6:
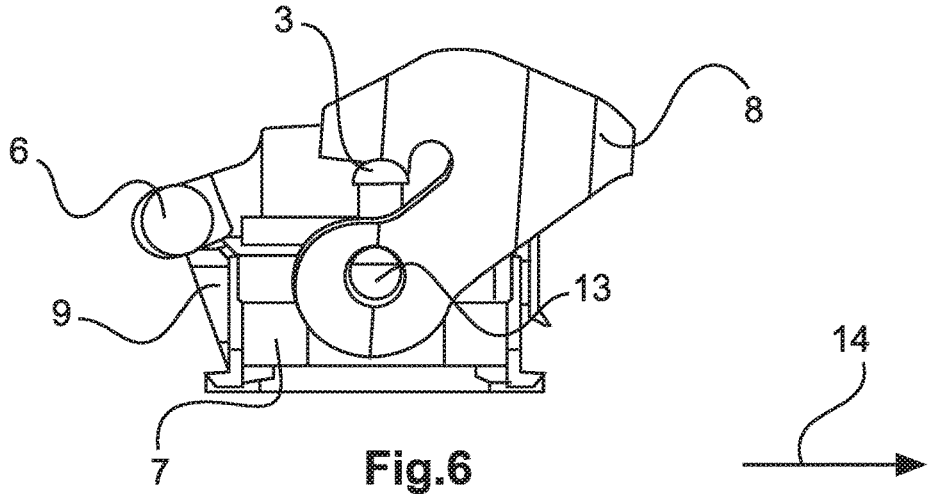
FIG. 6 shows a further lateral illustration of the system comprising a protective cap and an attachment housing with locking clip.
Figure 7:
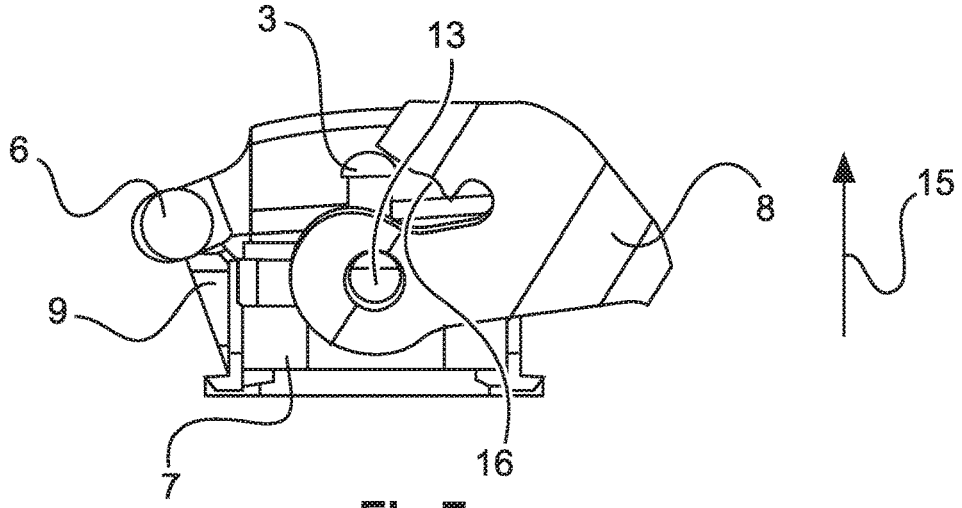
FIG. 7 shows a further lateral illustration of the system comprising a protective cap and an attachment housing with locking clip.

In FIGS. 5 to 7, the closure principle of the system comprising protective cap 1 and attachment housing 7 with a locking clip 8 is shown. The locking clip 8 is pivotably mounted via pins 13 integrally molded on the attachment housing 7.

In FIG. 5, the closed state of protective cap 1 and attachment housing 7 is shown. The locking pins 3 and an active region 16 of the locking clip 8 are shaped such that as the locking clip 8 is actuated in order to open the protective cap 1, the protective cap 1 is first moved in the direction of the arrow 14, as a result of which the locking lug 5 is guided over the latching projection 10 (FIG. 6). By way of an onward movement of the locking clip 8, the protective cap 1 is then moved in the direction of the arrow 15 and opened, as illustrated in FIG. 7. The protective cap 1 is unlocked and is forced upward by the sealing force as soon as the locking clip 8 has moved away from the locking pin 3.

An advantageous feature of the solution shown in the illustrated embodiments consists in the fact that the locking devices of the protective cap 1 can be used with and without locking clip 8 of an attachment housing 7.

The active region 16 of the locking clip 8 is formed by two end regions of the locking clip 8, which act on the respective locking pins 3. According to the illustrated embodiment, the active region 16 has an S shape in side view.

Figure 8:
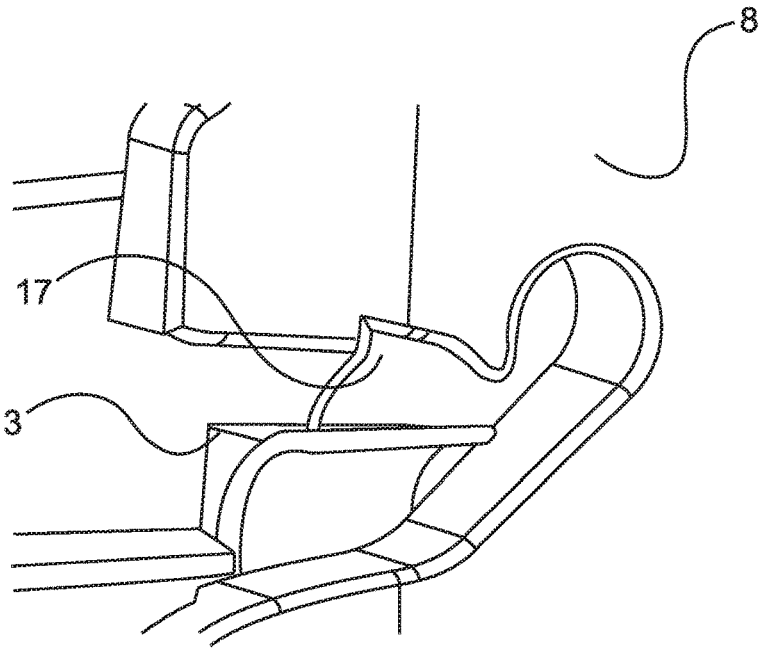
FIG. 8 shows a close-up of a locking pin and an active region of the locking clip.
Figure 9:
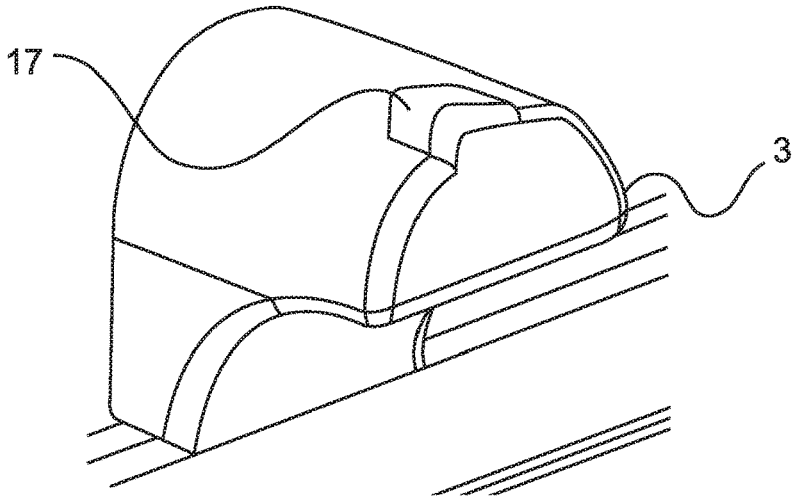
FIG. 9 shows a close-up of the locking pin.

A particularly advantageous embodiment of the protective cap 1 is shown in FIGS. 8 and 9. An additional latching projection 17 is integrally molded on the locking pin 3. If the friction between the locking pin 3 and the active region 16 of the locking clip 8 is too low, the latching projection 17 ensures that the protective cap 1 is forced sufficiently in the opening direction thereby.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A system, comprising:

an attachment housing having a latching projection;

a locking clip pivotably attached to the attachment housing, the locking clip configured relative to the attachment housing to pivot from an unlocked configuration to a locked configuration;

a protective cap coupled to the attachment housing to move between an open configuration and a closed configuration, the protective cap having a substantially box-like basic shape with narrow sides and wide sides, a respective locking pin on each of the narrow sides of the box-like basic shape, the locking pins projecting outwardly away from the narrow sides of the box-like basic shape, and a locking lug on one of the wide sides of the box-like basic shape for releasably engaging the latching projection of the attachment housing, and wherein the locking pins of the protective cap and an active region of the locking clip are shaped and configured relative to each other such that, as the locking clip is actuated from the locked configuration toward the unlocked configuration, the locking lug of the protective cap is shifted to disengage from the latching projection.

2. The system as claimed in claim 1, wherein a respective latching projection is integrally molded on each locking pin of the protective cap, each latching projection extending outwardly away from a convex surface of the locking pin on which the latching projection is integrally molded.

3. The system as claimed in claim 1, wherein each of the wide sides of the box-like basic shape has a respective locking device.

4. The system as claimed in claim 3, wherein the locking device on one of the wide sides is different than the locking device on the other one of the wide sides.

5. The system as claimed in claim 4, wherein the locking device of one of the wide sides is part of a hinge and the locking device of the other one of the wide sides is the locking lug.

6. The system as claimed in claim 1, wherein the protective cap comprises a first part of a hinge on one of the wide sides and a second part of the hinge is attached to or integrally molded on the attachment housing.

7. The system as claimed in claim 1, wherein, when the locking clip is in the locked configuration, the locking clip engages the locking pins of the protective cap which project outwardly away from the narrow sides of the box-like basic shape of the protective cap.

8. A system, comprising:

an attachment housing having a latching projection;

a protective cap pivotably coupled to the attachment housing to move between an open configuration and a closed configuration, the protective cap having a box-like basic shape with narrow sides and wide sides, a respective locking pin projecting outwardly away from each of the narrow sides, and a locking lug on one of wide sides configured to engage the latching projection and selectively hold the protective cap in the closed configuration; and a locking clip pivotably attached to the attachment housing, the locking clip configured relative to the attachment housing to pivot from an unlocked configuration to a locked configuration in which the locking clip engages the locking pins of the protective cap which project outwardly away from the narrow sides of the box-like basic shape of the protective cap, and wherein the locking pins of the protective cap and an active region of the locking clip are shaped and configured relative to each other such that, as the locking clip is actuated from the locked configuration toward the unlocked configuration, the locking lug of the protective cap is shifted to disengage from the latching projection.

* * * * *